US009549239B2

(12) United States Patent
Liu et al.

(10) Patent No.: US 9,549,239 B2
(45) Date of Patent: Jan. 17, 2017

(54) EARPHONE WIRE CONTROL DEVICE, EARPHONE, VOICE RECORDING SYSTEM AND VOICE RECORDING METHOD

(71) Applicant: TENCENT TECHNOLOGY (SHENZHEN) COMPANY LIMITED, Shenzhen (CN)

(72) Inventors: Yuejun Liu, Shenzhen (CN); Chenglin Liu, Shenzhen (CN)

(73) Assignee: Tencent Technology (Shenzhen) Company Limited, Shenzhen, Guangdong (CN)

( * ) Notice: Subject to any disclaimer, the term of this patent is extended or adjusted under 35 U.S.C. 154(b) by 233 days.

(21) Appl. No.: 14/458,352

(22) Filed: Aug. 13, 2014

(65) Prior Publication Data

US 2014/0363014 A1 Dec. 11, 2014

Related U.S. Application Data

(63) Continuation of application No. PCT/CN2013/071386, filed on Feb. 5, 2013.

(30) Foreign Application Priority Data

Feb. 22, 2012 (CN) ..... 2012 1 0040486

(51) Int. Cl.
*H04R 1/10* (2006.01)

(52) U.S. Cl.
CPC ..... *H04R 1/1041* (2013.01); *H04R 2201/107* (2013.01)

(58) Field of Classification Search
None
See application file for complete search history.

(56) References Cited

U.S. PATENT DOCUMENTS 3,641,507 A * 2/1972 Kosaka ..... G09B 5/04 434/320
5,572,377 A * 11/1996 Ueno ..... G11B 15/1875 360/31

(Continued)

FOREIGN PATENT DOCUMENTS

CN 103167367 A 6/2013
JP 3044839 B2 5/2000

OTHER PUBLICATIONS

Chinese Office Action for Application No. 2012100404862 dated May 23, 2015, and an English concise explanation of relevance thereof.

(Continued)

*Primary Examiner* — Joseph J Nguyen
*Assistant Examiner* — Kenny Truong
(74) *Attorney, Agent, or Firm* — Harness, Dickey & Pierce, P.L.C.

(57) ABSTRACT

An earphone wire control device, an earphone, a voice recording system and a voice recording system and method. When a switching unit turns on a first path, a microphone path is short-circuited, a first signal generating unit generates a recording start signal and cuts off the first path after generating the recording start signal so that the microphone path is turned on. When the switching unit turns on a second path, the microphone path is short-circuited, a second signal generating unit generates a recording stop signal and cuts off the second path after generating the recording stop signal.

10 Claims, 2 Drawing Sheets

(56) References Cited

U.S. PATENT DOCUMENTS

| | | | | |
|---|---|---|---|---|
| 2005/0078836 | A1 | 4/2005 | Ou | |
| 2006/0014559 | A1* | 1/2006 | Raman | H04M 1/656 455/550.1 |
| 2008/0032753 | A1* | 2/2008 | Nho | H04M 1/6058 455/569.1 |
| 2008/0253583 | A1* | 10/2008 | Goldstein | H04R 1/1091 381/92 |

OTHER PUBLICATIONS

International Preliminary Report for International Application No. PCT/CN2013/071386 dated Sep. 4, 2014.

* cited by examiner

EARPHONE WIRE CONTROL DEVICE, EARPHONE, VOICE RECORDING SYSTEM AND VOICE RECORDING METHOD

CROSS-REFERENCE TO RELATED APPLICATIONS

This application is a continuation of International Application No. PCT/CN2013/071386 filed on Feb. 5, 2013. This application claims the benefit and priority of Chinese Application No. 201210040486.2 filed on Feb. 22, 2012. The entire disclosures of each of the above applications are incorporated herein by reference.

FIELD

The present disclosure relates to voice processing technologies and to an earphone wire control device, an earphone, a voice recording system and a voice recording method.

BACKGROUND

This section provides background information related to the present disclosure which is not necessarily prior art.

Currently, an earphone used in conjunction with a device such as a mobile terminal generally includes a microphone, earplugs, earplug wiring and a wire control device. The wire control device is disposed on the earplug wiring. A user may control the earphone by using the wire control device when a voice call is made via the earphone.

However, since the same channel is used by both the wire control device and the microphone to transmit signals to the mobile terminal, when a user presses a button on the wire control device, the channel is occupied upon turning on the wire control device, so that the microphone cannot be used and therefore a recording function cannot be achieved. Thus, when a user needs to record voice information with an application of the mobile terminal, the user needs to press the button of the wire control device for an extended period of time. Since the channel is occupied by the wire control device, the microphone of the earphone cannot be used, and the voice information recording is impossible.

Thus, a limitation exists in the conventional earphone that the voice information recording cannot be performed by the microphone when the user presses the button of the wire control device.

SUMMARY

This section provides a general summary of the disclosure, and is not a comprehensive disclosure of its full scope or all of its features.

Examples of the present disclosure provide an earphone wire control device, an earphone, a voice recording system and a voice recording method, so as to record voice information while a wire control device is pressed by a user.

Technical solutions of the present disclosure are as follows.

An earphone wire control device includes:

a switching unit, a first signal generating unit, a second signal generating unit and a microphone; the switching unit and the first signal generating unit is connected in series to form a first path; the switching unit and the second signal generating unit is connected in series to form a second path; the first path, the second path and a microphone path where the microphone is located are connected in parallel;

the switching unit is to switch between the first path and the second path.

An earphone includes an above-described earphone wire control device.

A voice recording system includes: an earphone and a recording signal processing terminal;

the earphone comprises an above-described earphone wire control device and is to transmit a recording start signal and a recording stop signal to the recording signal processing terminal;

the recording signal processing terminal is to control a microphone in the earphone wire control device to record voice information after receiving the recording start signal, and to control the microphone in the earphone wire control device to stop recording the voice information after receiving the recording stop signal.

A voice recording method includes:

turning on, by a switch unit, a first path to short-circuit a microphone path where a microphone is located;

generating, by a first signal generating unit, a recording start signal; transmitting the recording start signal to a recording signal processing terminal; and cutting off the first path after the recording start signal is generated;

controlling, by the recording signal processing terminal, the microphone to record voice information after receiving the recording start signal;

turning on, by the switch unit, a second path to short-circuit the microphone path;

generating, by a second signal generating unit, a recording stop signal, transmitting the recording stop signal to the recording signal processing terminal; and cutting off the second path after the recording stop signal is generated;

controlling, by the recording signal processing terminal, the microphone to stop recording the voice information after receiving the recording stop signal.

It can be seen for the above-described technical solutions, by means of switching among the first path, the second path and the microphone path, the voice information may be recorded while the button of the wire control device is pressed, thereby overcoming the defect that the voice information cannot be recorded while the button of the wire control device is pressed since the wire control device and the microphone use the same channel in the existing earphones. Hence, operability of earphones is enhanced and combination of earphones and other devices is promoted.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

In order to make the object, technical solution, and merits of the present disclosure clearer, the present disclosure will be illustrated in detail hereinafter with reference to the accompanying drawings and specific embodiments.

Figure 1:
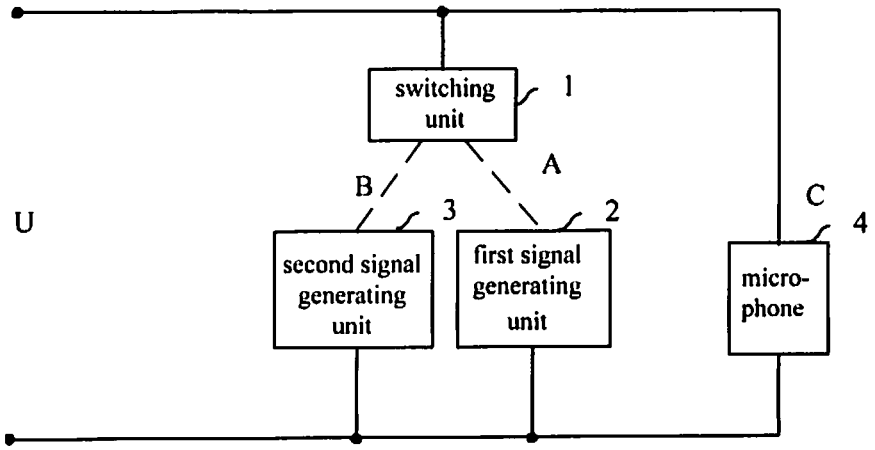
FIG. 1 is a block diagram illustrating an earphone wire control device according to various embodiments.

FIG. 1 is a block diagram of an earphone wire control device according to various embodiments. As shown in FIG. 1, the earphone wire control device includes a switching unit 1, a first signal generating unit 2, a second signal generating unit 3, and a microphone 4.

When the switching unit 1 is connected to the first signal generating unit 2, the switching unit 1 and the first signal generating unit 2 are connected in series to form a first path A. When the switching unit 1 is connected to the second signal generating unit 3, the switching unit 1 and the second signal generating unit 3 are connected in series to form a second path B. The first path A and the second path B are connected in parallel with a microphone path C where the microphone 4 is located, respectively.

The switching unit 1 may be switched between the first path A and second path B. According to various embodiments, the switch unit 1 may be a switch with a variety of specific forms, such as a single-pole double-throw switch.

When the switching unit 1 is a single-pole double-throw switch, it may include a contact and two terminals. The contact, which is generally the end connected to a handle of the switch, is displaceable and connects to a first rail of a power supply (i.e. which supplies the current to the contact). The terminals are typically fixed and connect the outer rail of the power supply to the first signal generating unit 2 and the second signal generating unit 3, respectively.

When the switch unit 1 is switched to the first path A, the microphone path C is short-circuited. The first signal generating unit 2 generates a recording start signal first, and cuts off the first path A immediately after generating the recording start signal. After the first path A is cut off, the microphone path C is turned on.

When the switch unit 1 is switched to the second path B, the microphone path C is short-circuited. The second signal generating unit 3 generates a recording stop signal, and cuts off the second path B immediately after generating the recording stop signal. After the second path B is cut off, the microphone path C is turned on.

According to various embodiments, the switching unit 1, the first signal generating unit 2, and the second signal generating unit 3 constitute a control circuit for the microphone 4, and the control circuit is connected in parallel with the microphone 4. According to various embodiments, the control circuit includes a mirror circuit having two halves. The principle of operation of the two halves of the mirror circuit is the same or similar, and each half may implement a function like a time relay.

Each of the first signal generating unit 2 and the second signal generating unit 3 includes a signal generating function and a circuit cut-off function.

Referring to the signal generating function, an electrical signal which can be recognized by a mobile terminal (such as a mobile phone) is generated after the circuit is turned on.

Referring to the circuit cut-off function, the circuit is automatically cut off after the electrical signal is generated as required, so as to hand over the occupied path to the microphone.

According to various embodiments, when a user needs to record voice information, the user may first press a button on the earphone wire control device, correspondingly, the switching unit 1 is switched to the first path A, and the first path A is turned on. At this time, the first signal generating unit 2 in the first path A occupies the solely path, the microphone 4 is short-circuited, and the microphone 4 cannot work since its channel is occupied. The first signal generating unit 2 generates a recording start signal and sends the recording start signal to sound processing software in the mobile terminal. The sound processing software in the mobile terminal activates a function relating to recording after receiving the recording start signal. After the recording start signal is generated, the first signal generating unit 2 in the first signal path A immediately cuts off the first path A and releases the path so that the microphone 4 may work normally. Because the above-mentioned actions are done quickly, the user can speak to the microphone after pressing the button on the earphone wire control device.

When the user finishes recording the voice information, the user releases the button on the earphone wire control device and, correspondingly, the switching unit 1 is switched to the second path B, and the second path B is turned on. At this time, the microphone 4 is short-circuited, and the second signal generating unit 3 on the second path B occupies the path and starts working. The second signal generating unit 3 sends a signal to notify the voice processing software in the mobile terminal to end recording, thereafter the second signal generating unit 3 itself cuts off the second path B and hands over the corresponding path.

According to various embodiments, the first signal generating unit 2 and the second signal generating unit 3 may include capacitors, resistors, transistors and the like.

Figure 2:
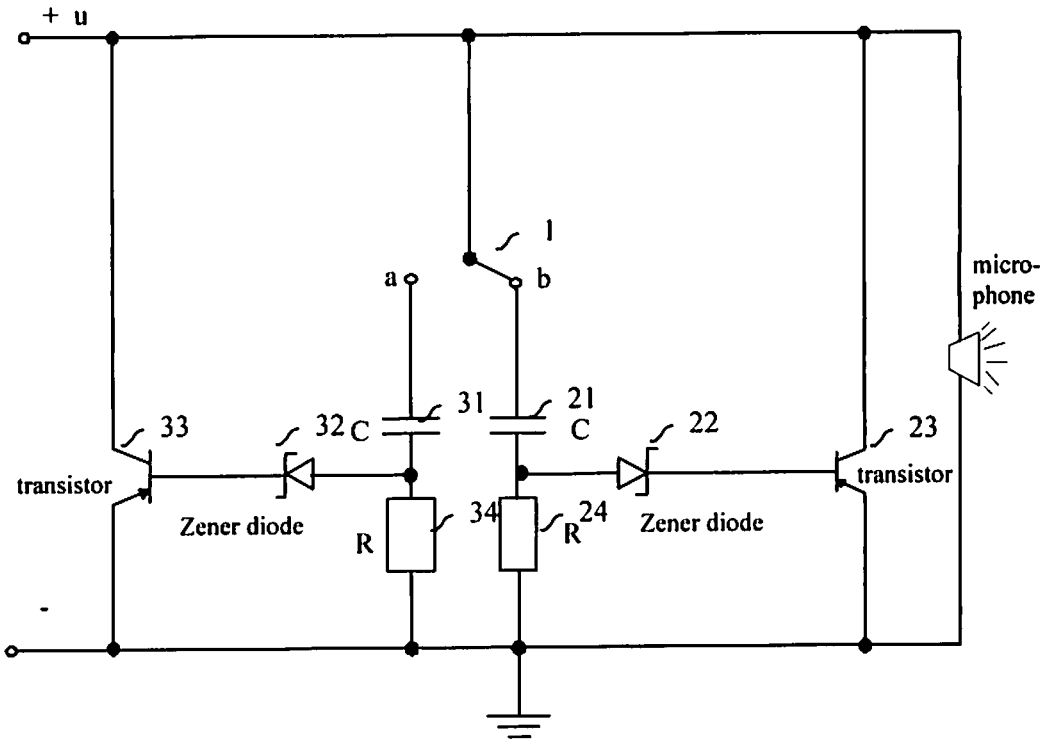
FIG. 2 is a circuit diagram of an earphone wire control device according to various embodiments.

FIG. 2 is a diagram illustrating a circuit of an earphone wire control device according to various embodiments.

A single-pole double-throw switch 1 in FIG. 2 corresponds to the switching unit 1 in FIG. 1. A capacitor 21, a Zener diode 22, a transistor 23, and a resistor 24 in FIG. 2 correspond to the first signal generating unit 2 in FIG. 1. A capacitor 31, a Zener diode 32, a transistor 33 and a resistor 34 in FIG. 2 corresponds to the second signal generating unit 3 in FIG. 1.

As shown in FIG. 2, the capacitor 21, the Zener diode 22, the transistor 23, the resistor 24 and the capacitor 31, the Zener diode 32, the transistor 33, and the resistor 34 constitute a mirror circuit which is symmetrical in left and right.

An anode of the capacitor 21 is connected to one terminal of the single-pole double-throw switch 1 and a cathode of the capacitor 21 is connected to both of a terminal of the resistor 24 and an anode of the Zener diode 22. A cathode of the Zener diode 22 is connected to a base of the transistor 23. A collector of the transistor 23 is connected to a power supply U and an emitter of the transistor 23 is grounded.

An anode of the capacitor 31 is connected to the other terminal of the single-pole double-throw switch 1 and a cathode of the capacitor 31 is connected to both of a terminal of the resistor 34 and an anode of the Zener diode 32. A cathode of the Zener diode 32 is connected to a base (B) of the transistor 33. A collector (C) of the transistor 33 is connected to the power supply U and an emitter (E) of the transistor 33 is grounded.

Referring to FIG. 2, in operation, when the single-pole double-throw switch 1 in the circuit is switched to the terminal b from the terminal a, the capacitor (C) 21 on the right portion of the mirror whose voltage is 0 starts to be charged the voltage of the resistor (R) 24 in the right is larger than the sum of the break-over voltage between BE of the transistor 23 in the right and the voltage stabilization value of the Zener diode 22, and therefore the transistor 23 is turned on and the microphone is short-circuited. It can be seen that the voltage U of the control circuit is 0, which means the control circuit sends a control signal with low level, i.e., the recording start signal.

After a period of time which may be determined by the values of the capacitor (C) 21 and the resistance (R) 24 and which may be very short, the voltage of the capacitance (C) 21 in the right is gradually increased and the voltage of the resistor (R) 24 in the right is gradually decreased. When the voltage of the resistor (R) 24 is smaller than the sum of the break-over voltage between BE of the transistor 23 in the right and the voltage stabilization value of the Zener diode 22, the transistor 23 is turned off, the voltage across both ends of the control circuit is recovered, which means the control circuit stops sending low level signals, and the microphone has begun to record voice information.

Referring to FIG. 2, when the single-pole double-throw switch 1 is switched to the left from the right, the circuit in the right is turned off and the circuit in the left repeats the similar operations of the circuit in the right.

Specifically, when the single-pole double-throw switch 1 in the circuit is switched to the terminal a from the terminal b, the capacitor (C) 31 in the left whose voltage is 0 starts to be charged, the voltage of the resistor (R) 34 in the left is larger than the sum of the break-over voltage between BE of the transistor 33 in the left and the voltage stabilization value of the Zener diode 32, and therefore the transistor 33 is turned on and the microphone is short-circuited. It can be seen that the voltage U of the control circuit is 0, which means the control circuit sends a control signal with low level, i.e., the recording stop signal.

After a period of time which may be determined by the values of the capacitor (C) 31 and the resistance (R) 34 and which may be very short, the voltage of the capacitance (C) 31 in the left is gradually increased and the voltage of the resistor (R) 34 in the left is gradually decreased. When the voltage of the resistor (R) 34 is smaller than the sum of the break-over voltage between BE of the transistor 33 in the left and the voltage stabilization value of the Zener diode 32, the transistor 33 is turned off, the voltage across both ends of the control circuit is recovered, which means the control circuit stops sending low level signals, and the microphone has finished recording the voice information.

According to various embodiments, the processing of switching the single-pole double-throw switch from the left to the right corresponds to pressing a recording button by the user, and the user is ready to start talking. At this time the control circuit sends the recording start signal and then automatically ends occupation of the channel so that the channel may be used by the microphone to work normally.

The process of switching the single-pole double-throw switch from the terminal b to the terminal a corresponds to releasing the recording button by the user, at this time the control circuit sends the recording stop signal, and then automatically ends occupation of the channel.

In a signal processing terminal, such as a mobile terminal, when a first control signal, i.e., the recording start signal is received from the earphone, a recording function is started and voice information of the user is recorded. When a second control signal, i.e., the recording stop signal is received from the earphone, the recording of the voice information is stopped, and the recorded voice information is processed.

In the above descriptions, the earphone wire control device is described with specific electrical elements such as resistors, capacitors and transistors. Those skilled in the art will realize that this detailed circuit configuration shown in FIG. 2 is merely exemplary, and is not intend to limit the protection scope of the present disclosure.

The earphone wire control device described in the foregoing descriptions may be applied to a variety of earphones, such as dynamic earphones, moving iron type earphones, electrostatic earphones, and equal magnetic earphones. Moreover, based on different style type, the earphone wire control device described in the foregoing descriptions may be applied to earplug type earphones, coped lug type earphones, in-ear earphones, headphones, and so on.

Various embodiments of the present disclosure also provide a voice recording system.

Figure 3:
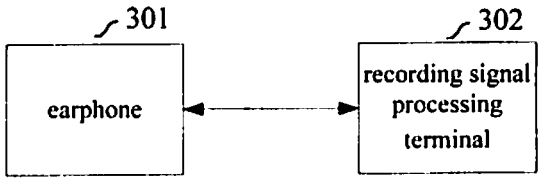
FIG. 3 is a block diagram illustrating a voice recording system according to various embodiments.

FIG. 3 is a diagram illustrating a voice recording system according to various embodiments.

As shown FIG. 3, the voice recording system includes an earphone 301 and a recording signal processing terminal 302. The earphone includes the above-described earphone wire control device and is capable of sending the recording start signal and the recording stop signal generated by the earphone wire control device to the recording signal processing terminal 302.

The recording signal processing terminal controls the microphone in the earphone wire control device to record voice information after receiving the recording start signal, and controls the microphone to stop recording the voice information after receiving the recording stop signal.

According to various embodiments, the recording signal processing terminal 302 may be a mobile terminal, a notebook computer, a tablet computer or a personal digital assistant (PDA), and so on.

Although various embodiments of the recording signal processing terminal are provided, those skilled in the art will realize that the protection scope of examples of the present disclosure is not limited thereto.

Various embodiments of the present disclosure also provide a voice recording method.

Figure 4:
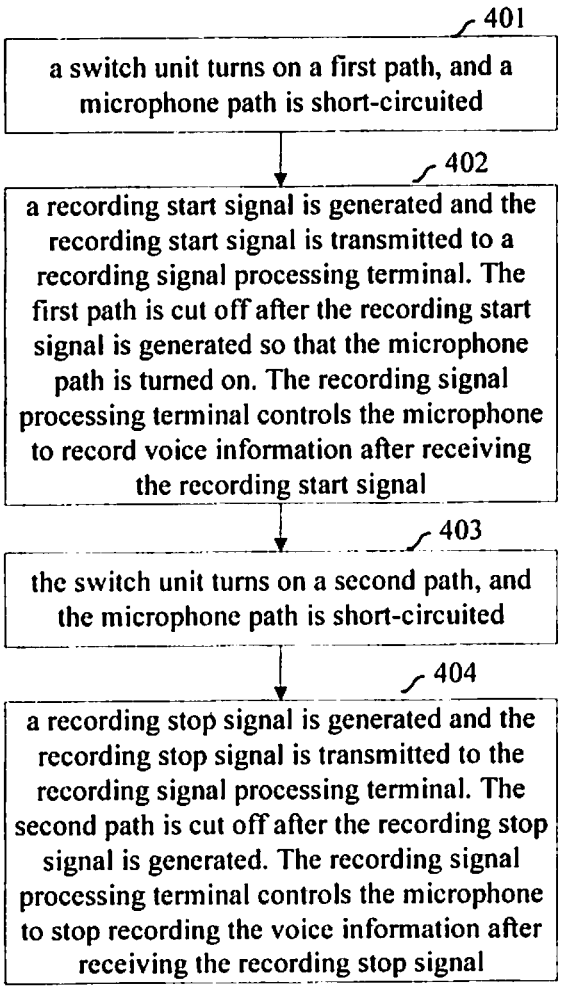
FIG. 4 is a flowchart illustrating a voice recording method according to various embodiments.

FIG. 4 is a flowchart illustrating a voice recording method according to various embodiments.

As shown in FIG. 4, the method comprises the following process.

At 401, a switch unit turns on a first path, and a microphone path is short-circuited.

At 402, a recording start signal is generated and the recording start signal is transmitted to a recording signal processing terminal. The first path is cut off after the recording start signal is generated so that the microphone path is turned on. The recording signal processing terminal controls the microphone to record voice information after receiving the recording start signal.

At 403, the switch unit turns on a second path, and the microphone path is short-circuited.

At 404, a recording stop signal is generated and the recording stop signal is transmitted to the recording signal processing terminal. The second path is cut off after the recording stop signal is generated. The recording signal processing terminal controls the microphone to stop recording the voice information after receiving the recording stop signal.

According to various embodiments, the recording signal processing terminal may be a mobile terminal, a notebook computer, a tablet computer or a PDA, and so on.

In summary, according to various embodiments, by means of switching among the first path, the second path and the microphone path, the voice information may be recorded while the button of the wire control device is pressed, thereby overcoming the defect that the voice information cannot be recorded while the button of the wire control device is pressed since the wire control device and the microphone use the same channel in the existing earphones. Hence, operability of earphones is enhanced and combination of earphones and other devices is promoted.

It should be understood that the above description displays various preferred embodiments and is in no way intended to limit the scope of the present disclosure. Any modifications, equivalents, improvements and the like made within the spirit and principle of the present disclosure should be encompassed in the scope of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Reference throughout this specification to "one embodiment," "an embodiment," "specific embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in a specific embodiment," or the like in the singular or plural in various places throughout this specification are not necessarily all referring to the same embodiment. Furthermore, the particular features, structures, or characteristics may be combined in any suitable manner in one or more embodiments.

What is claimed is:

1. An earphone wire control device, comprising:

a switching unit, a first signal generating unit, a second signal generating unit and a microphone;

wherein the switching unit and the first signal generating unit are connected in series to form a first path;

wherein the switching unit and the second signal generating unit are connected in series to form a second path; the first path, the second path and a microphone path where the microphone is located are connected in parallel;

wherein the switching unit switches between the first path and the second path: and wherein when the switching unit turns on the first path, the microphone path is short-circuited, the first signal generating unit generates a recording start signal and cuts off the first path after generating the recording start signal;

when the switching unit turns on the second path, the microphone path is short-circuited, the second signal generating unit generates a recording stop signal and cuts off the second path after generating the recording stop signal.

2. The earphone wire control device according to claim 1, wherein the first signal generating unit and the second signal generating unit form a mirror circuit with same configuration.

3. The earphone wire control device according to claim 1, wherein the switching unit (1) is a single-pole double-throw switch.

4. The earphone wire control device according to claim 1, wherein the second signal generating unit comprises a capacitor, a Zener diode, a transistor and a resistor, and wherein an anode of the capacitor is connected to the single-pole double-throw switch and a cathode of the capacitor is connected to both of an end of the resistor and an anode the Zener diode; a cathode of the Zener diode is connected to a base of the transistor; and a collector of the transistor is connected to a power supply and an emitter of the transistor grounded.

5. An earphone wire control device, comprising:

a switching unit, a first signal generating unit, a second signal generating unit and a microphone:

wherein the switching unit and the first signal generation unit are connected in series to form a first path;

wherein the switching unit and the second signal generating unit are connected in series to form a second path; the first path, the second path and a microphone path where the microphone is located are connected in parallel;

wherein the switching unit switches between the first path and the second path; and wherein the switching unit is a single-pole double-throw switch, wherein the first signal generating unit comprises a capacitor , a Zener diode , a transistor and a resistor;

an anode of the capacitor is connected to the single-pole double-throw switch and a cathode of the capacitor is connected to both of an end of the resistor and an anode of the Zener diode; a cathode of the Zener diode is connected to a base of the transistor; a collector of the transistor is connected to a power supply and an emitter of the transistor is grounded.

6. An earphone comprising an earphone wire control device according to claim 1.

7. A voice recording system, comprising an earphone and a recording signal processing terminal;

wherein the earphone comprises an earphone wire control device according to claim 2, and transmits a recording start signal and a recording stop signal to the recording signal processing terminal;

the recording signal processing terminal controls a microphone in the earphone wire control device to record voice information after receiving the recording start signal, and controls the microphone in the earphone wire control device to stop recording the voice information after receiving the recording stop signal.

8. The voice recording system according to claim 7, wherein the recording signal processing terminal is one of a mobile terminal, a notebook computer, a tablet computer or a personal digital assistant (PDA).

9. A voice recording method, comprising:

providing, by a switch unit, a first path to short-circuit a microphone path where a microphone is located;

generating, by a first signal generating unit, a recording start signal;

transmitting the recording start signal to a recording signal processing terminal;

cutting off the first path after the recording start signal is generated;

controlling, by the recording signal processing terminal, the microphone to record voice information after receiving the recording start signal;

turning on, by the switch unit, a second path to short-circuit the microphone path;

generating, by a second signal generating unit, a recording stop signal, and transmitting the recording stop signal to the recording signal processing terminal;

cutting off the second path after the recording stop signal is generated; and controlling, by the recording signal processing terminal, the microphone to stop recording the voice information after receiving the recording stop signal.

10. The voice recording method according to claim 9, wherein the recording signal processing terminal is one of a mobile terminal, a notebook computer, a tablet computer or a personal digital assistant.

* * * * *